US010252340B2

(12) United States Patent
Gong et al.

(10) Patent No.: US 10,252,340 B2
(45) Date of Patent: Apr. 9, 2019

(54) METHOD FOR PREPARING METAL POWDER

(71) Applicant: Suzhou Smart Advanced Coating Technologies Co. Ltd, Suzhou (CN)

(72) Inventors: Qiang Gong, Suzhou (CN); Cairong Zhou, Suzhou (CN)

(73) Assignee: SUZHOU SMART ADVANCED COATING TECHNOLOGIES CO. LTD., Suzhou (CN)

( * ) Notice: Subject to any disclaimer, the term of this patent is extended or adjusted under 35 U.S.C. 154(b) by 154 days.

(21) Appl. No.: 15/325,659

(22) PCT Filed: Aug. 11, 2015

(86) PCT No.: PCT/CN2015/086610

§ 371 (c)(1),
(2) Date: Jan. 11, 2017

(87) PCT Pub. No.: WO2016/023461

PCT Pub. Date: Feb. 18, 2016

(65) Prior Publication Data

US 2017/0173698 A1 Jun. 22, 2017

(30) Foreign Application Priority Data

Aug. 12, 2014 (CN) ..... 2014 1 0394624

(51) Int. Cl.
*B22F 9/24* (2006.01)
*C22B 15/00* (2006.01)

(52) U.S. Cl.
CPC ..... *B22F 9/24* (2013.01); *C22B 15/0089* (2013.01); *C22B 15/0095* (2013.01)

(58) Field of Classification Search
None
See application file for complete search history.

(56) References Cited

U.S. PATENT DOCUMENTS 6,290,747 B1 * 9/2001 White ..... C22B 3/44 423/27
2010/0261827 A1 * 10/2010 Peri ..... B22F 9/24 524/440

(Continued)

FOREIGN PATENT DOCUMENTS

CN 1227148 A 9/1999
CN 102528070 A 7/2012

OTHER PUBLICATIONS

Written Opinion of the International Search Authority in PCT/CN2015/086610, dated Sep. 30, 2015.

*Primary Examiner* — George Wyszomierski
(74) *Attorney, Agent, or Firm* — SZDC Law PC

(57) ABSTRACT

Provided is a method for preparing metal powder; a metal nitrate or metal sulfate is combined with ammonia water to produce an ammonia-containing complex metal salt solution; the said solution is then quantitatively jet-mixed with the solution containing the hydroxylamine compounds, and reacted under intense stirring; a dispersant solution is added during the reaction process, and after the reaction is complete, the solution is separated by centrifugation to yield the metal power. The method of the present invention can effectively control the reaction rate during the production process, and well control the nucleation rate and dispersity, with the produced metal powder having very good crystallinity, sphericity, tap property and dispersity.

17 Claims, 2 Drawing Sheets

(56) References Cited

U.S. PATENT DOCUMENTS

| | | | | |
|---|---|---|---|---|
| 2011/0296950 | A1* | 12/2011 | Buscall | B22F 1/0022 75/370 |
| 2013/0205950 | A1 | 8/2013 | Jurk et al. | |
| 2014/0024026 | A1* | 1/2014 | Alocilja | G01N 33/5434 435/6.11 |
| 2017/0246690 | A1* | 8/2017 | Murphy | B22F 9/24 |

* cited by examiner

METHOD FOR PREPARING METAL POWDER

FIELD OF THE INVENTION

The present invention relates to the field of materials technology, especially a method for preparing metal powder.

BACKGROUND OF THE INVENTION

Metal powder has wide applications in electronic component manufacturing, electroplating, and batteries of the electronic industry, chemical catalysis, jewelry and other industries. With development of the electronic components in the direction of miniaturization and high performance, higher requirements have been put forward for sintering activity, dispersity, sphericity, crystallinity and other performances of the metal powder. Currently, preparation of metal powder includes physical and chemical methods. The physical method includes an atomization method, a vapor phase evaporation condensation method, a grinding method, and so on, and the chemical method includes a liquid phase reduction method, an electrochemical deposition method, an electrolysis method, and so on. Due to the problems of high cost and low yield with the physical method, the currently widely used method is the chemical liquid phase reduction method, that is, metal is reduced by a chemical reaction from a metal-containing salt solution or metal oxide, such as CN1301205, Sinter-Active Metal and Alloy Powders for Powder Metallurgy Applications and Methods for Their Production and Their Use. The China Patent CN101597777 discloses a method of reducing metal oxide or salt into metal by the electrolysis method.

CONTENTS OF THE INVENTION

A purpose of the present invention is to provide a method for preparing metal powder that is different from the prior art.

In order to attain the above purpose, a technical solution of the present invention is to provide a method for preparing metal powder, which is characterized in that this method comprises the following steps:

(1) Preparation of an ammonia-containing complex metal salt solution: dissolving a metal nitrate solid or metal sulfate solid or an equivalent amount of metal nitrate liquid or metal sulfate liquid into deionized water, adding ammonia water, keeping a molar ratio of $[NH_3]$:[metal ion]=1:0.5-5 in the solution, stirring sufficiently before adding an acidic additive in an amount of 0.01%-10% by mass of the prepared ammonia-containing complex metal salt solution, and meanwhile heating this ammonia-containing complex metal salt solution to 30° C.-90° C.;

(2) preparation of a solution containing hydroxylamine compounds: used as a metal ion reducing agent, this solution is prepared by adding an equivalent amount of hydroxylamine compound to deionized water; according to the metal content of the ammonia-containing complex metal salt solution, keeping a molar ratio of [metal ion]:[hydroxylamine]=1:0.1-10 in the solution, stirring sufficiently before adding a pH regulator to regulate the pH in 2.5-9.5, and meanwhile heating this reducing agent solution to 30° C.-90° C.; and (3) injecting to mix the ammonia-containing complex metal salt solution and the solution containing the hydroxylamine compounds to allow a reduction reaction to happen under vigorous stirring, and centrifugating after completion of the reaction to obtain metal powder with different particle size.

In a preferred technical solution of the present invention, for the preparation of the ammonia-containing complex metal salt solution in Step (1), according to the requirement that the metal ion content in the prepared ammonia-containing complex metal salt solution is 10-500 g/L, adding 1%-30% by mass of ammonia water, stirring sufficiently before adding an acidic additive, and meanwhile heating this solution to 30° C.-90° C.

In a preferred technical solution of the present invention, for the preparation of the ammonia-containing complex metal salt solution in Step (1), the acidic additive selected from organic acids and the metal salts thereof well controls the oxidation-reduction reaction rate and the nucleation rate during the reaction.

In a preferred technical solution of the present invention, for the preparation of the ammonia-containing complex metal salt solution in Step (1), the organic acid is selected from saturated fatty acids and the metal salts thereof, as well as unsaturated fatty acids and the metal salts thereof, or the mixtures thereof. The saturated fatty acids and metal salts thereof are selected from $C_nH_{2n+1}COOH$, wherein n=1, 2, 3, 4, 5, 6, 7, 8, 9, 10, 11, 12, 13, 14, 15, 16 or the combination thereof, and the metal salts are selected from sodium or potassium salts; the unsaturated fatty acids and the metal salts thereof are selected from $C_nH_{2n}COOH$, wherein n=10, 11, 12, 13, 14, 15, 16, 17, 18, 19, 20 or the combination thereof, and the metal salts are selected from sodium or potassium salts.

In a preferred technical solution of the present invention, the hydroxylamine compound in Step (2) is selected from hydroxylamine, hydroxylamine sulfate, hydroxylamine nitrate, or the mixture thereof.

In a preferred technical solution of the present invention, the pH regulator in Step (2) is selected from inorganic bases and inorganic acids or the salts thereof.

In a preferred technical solution of the present invention, the pH regulator added in Step (2) is selected from sodium hydroxide, potassium hydroxide, sodium carbonate, potassium carbonate, nitric acid or ammonium nitrate, hydrochloric acid or ammonium chloride, sulfuric acid or ammonium sulfate solution, or the combination thereof.

In a preferred technical solution of the present invention, in Step (3), using the pressure generated by a pump or compressed air to inject and mix quantitatively via a micropore the ammonia-containing complex metal salt solution and the hydroxylamine solution prepared in the above steps, with the injection flow rate of the two solutions controlled in the range of 0.2-50 L/min, and reacting under vigorous stirring with a paddle or impeller as a stirring blade at a stirring speed of 10-500 rpm, and centrifugating after completion of the reaction to obtain various kinds of spherical and nearly spherical silver powder.

In a preferred technical solution of the present invention, in Step (3), adding a dispersant solution at a temperature of 30° C.-90° C. dropwise quantitatively in the course of reaction at a dropping rate of 0.2-10 L/min and an amount of 0.1-5 L.

In a preferred technical solution of the present invention, for the preparation of the dispersant solution, dissolving into deionized water one or more kinds of acidic polyhydroxy compounds or the salt compounds thereof or the mixture thereof at a content of 20-100 g/L; and then stirring sufficiently before adding an amino acid or the polypeptide compound thereof at an amount of 0%-10% by mass of the prepared dispersant solution.

In a preferred technical solution of the present invention, the added amino acid or the polypeptide compound thereof is selected from methionine, glutamic acid, alanine, gelatin or the combination thereof.

In a preferred technical solution of the present invention, the acidic polyhydroxy compounds or the salt compounds thereof are selected from triethyl hexyl phosphate, sodium lauryl sulfate, methyl amyl alcohol, cellulose derivatives, polyacrylamide, guar gum, polyethylene glycol, fatty acid polyglycol ester, vitamins, and the salts thereof.

In a preferred technical solution of the present invention, the metal includes silver, copper and tin.

In a preferred technical solution of the present invention, the metal powder is spherical and nearly spherical.

The reaction temperature of the solution of the preferred system of the present invention is 30° C.-90° C., facilitating the reaction. Of course, it is not conducive to the reaction for the temperature is too high or too low. For the hydroxylamine compound solution in the present invention, adjusting the pH between 2.5 and 9.5 depending on the production requirements of the metal powder; the produced silver powder has a less particle size when the pH is in the alkaline range, with D50 at 0.5-1 um; the produced silver powder has a greater particle size when the pH is in the acidic range, with D50 at 1.5-2 um. Therefore, adjustment can be made in the production process according to the specific requirements on the particle size of the produced metal powder.

The present invention has the following advantages and benefits:

(1) The reducing agent solution used in the method of the present invention is a new reducing agent system of hydroxylamine compounds, which are selected from hydroxylamine, hydroxylamine sulfate, hydroxylamine nitrate or the mixture thereof at the pH of 2.5-9.5, and can quickly and reliably reduce the metal particles in the ammonia-containing complex metal salt solution into the metal power, such as reducing silver ions into silver power, also ensuring that the formed silver power is spherical or nearly spherical.

(2) The method of the present invention utilizes quantitative injecting and mixing, and adds the dispersant solution dropwise in the course of reaction, which can well control dispersity of the metal powder during the reaction, and solve the agglomeration problem with metal powder such as silver powder in the production process, with the metal powder having an average particle size of 0.1-10 um.

(3) The method of the present invention can effectively control the reaction rate of the spherical and nearly spherical metal powder in the production process, and well control the nucleation rate and dispersity, with the produced spherical and nearly spherical metal powder having very good crystallinity, sphericity, tap property and dispersity.

(4) The preparation method of the present invention can be applied to industrial production; for example, the scale production of silver powder can reach 50-250 kg/batch, which has significant advantages relative to the existing laboratory preparation method of the silver powder production technology.

(5) The preparation method of the present invention is simple, uses inexpensive raw materials, can easily control the process, can fully complete the reaction, and has stable product quality for the different production batches, thus greatly reducing the product failure rate and bringing considerable economic benefits to the enterprise; meanwhile the wastewater generated in the production process is directly used as landscaping water after oxidation treatment, filtration and combination, thus realizing clean production and water recycle.

DETAILED DESCRIPTION OF THE EMBODIMENTS

Figure 1:
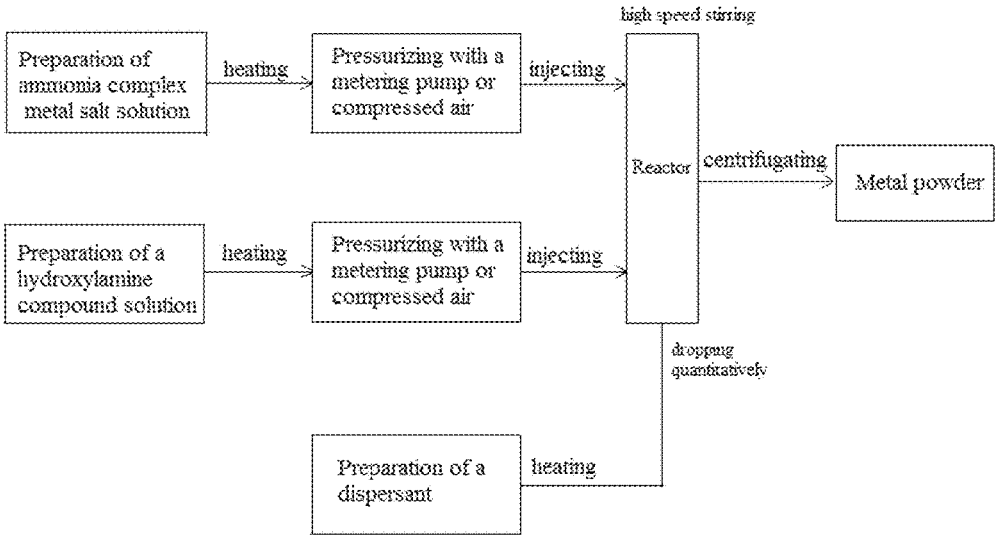
FIG. 1 is a flow diagram of the method of the present invention.
Figure 2:
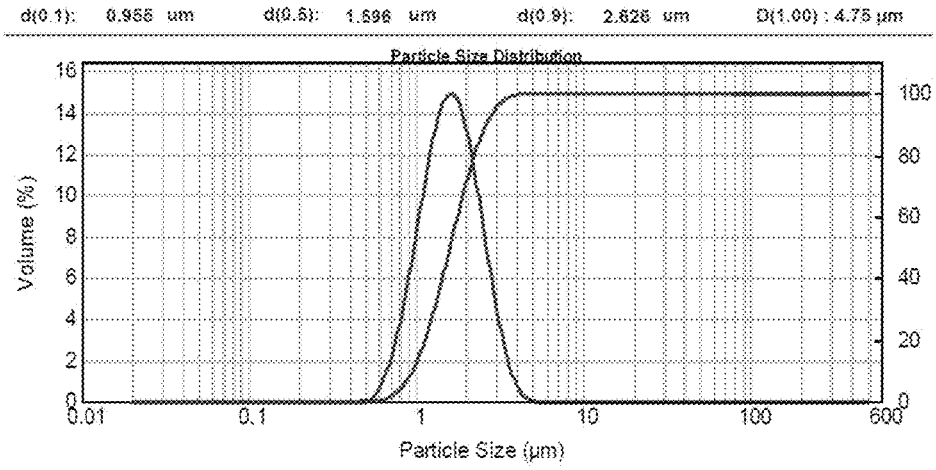
FIG. 2 is a schematic diagram of the particle size detection of the metal powder prepared by the method of the present invention.
Figure 3:
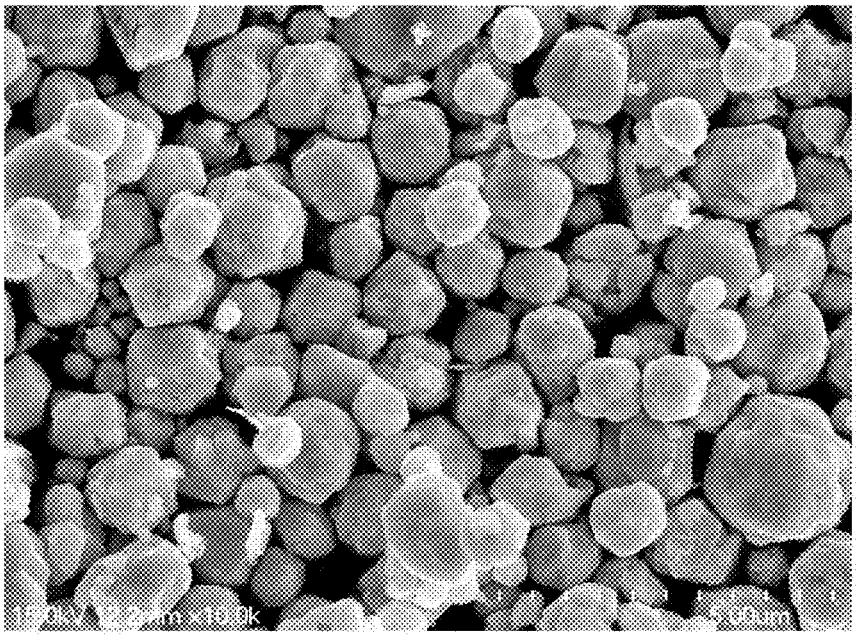
FIG. 3 is an electronic microscopic image of the spherical silver powder prepared by the method of the present invention.

In order to further understand the present invention, a preferred solution of the present invention will be described below with reference to specific examples. However, it should be understood that the description is used to further illustrate the features and advantages of the present invention, instead of limiting the claims thereof.

EXAMPLE 1

(1) Preparation of an ammonia-containing complex silver solution: Dissolving a silver nitrate or sulfate solid or an equivalent amount of silver nitrate or sulfate liquid into deionized water, adding ammonia water, keeping a molar ratio of $[NH_3]$:[silver ion]=1:0.5-5 in the solution, stirring sufficiently before adding an organic acid and the metal salts thereof at an amount of 0.01% to 10% by mass of the prepared ammonia-containing complex metal salt solution, and meanwhile heating this ammonia-containing complex silver solution to 50° C.-85° C.;

(2) preparation of a solution containing hydroxylamine compounds: this solution is prepared by adding an equivalent amount of hydroxylamine sulfate to deionized water; according to the silver content in the ammonia-containing complex silver solution, keeping a molar ratio of [silver ion]:[hydroxylamine]=1:0.1-5 in the solution, stirring sufficiently before adding an acidic or basic pH regulator to regulate the pH in 2.5-9.5, and meanwhile heating this reducing agent solution to 50° C.-85° C.;

(3) preparation of a dispersant solution: dissolving into deionized water one or more kinds of acidic polyhydroxy compounds or the salt compounds thereof or the mixture thereof at a content of 20-100 g/L, and heating the solution to 30° C.-90° C.;

(4) using a metering pump to inject and mix the ammonia-containing complex silver solution and the solution containing the hydroxylamine compounds quantitatively through a micropore, having reduction reaction under vigorous stirring, meanwhile adding the dispersant solution dropwise quantitatively at a dropping rate of 0.2-10 L/min, and centrifugating after completion of the reaction to obtain silver powder with different particle size.

EXAMPLE 2

Preparing 300 mL silver nitrate solution containing 400 g/L silver in a 2000 mL jar, adding 200 mL ammonia water at a concentration of 20% by mass to obtain a silver-ammonia solution, adding 0.7 g acetic acid as an additive, and heating up to 65° C. for later use;

preparing a hydroxylamine-containing solution in another 2000 mL jar: dissolving 50 g hydroxylamine sulfate and 50 g hydroxylamine nitrate in 500 mL deionized water, adding potassium carbonate to regulate the pH in 6.5-8.0, and heating up to 50° C.;

preparing a dispersant solution in a 500 mL jar: dissolving 15 g fatty acid polyglycol ester and guar gum in 300 mL deionized water, adding 1.5 g methionine, and heating up to 55° C.;

injecting and mixing the above two prepared silver-ammonia solution and hydroxylamine reducing agent solution quantitatively in a 5000 mL jar by a metering pump through a micropore at a controlled flow rate of 250 mL/min, beginning to stir at a stirring rate of 20 rpm, adding the dispersant solution dropwise in the course of reaction at a controlled dropping rate of 200 mL/min, and centrifugating after completion of the reaction to obtain spherical or nearly spherical silver powder at an average particle size of 0.1-10 um.

EXAMPLE 3

Formulating 300 mL silver nitrate solution containing 400 g/L silver in a 2000 mL jar, adding 200 mL ammonia water at a concentration of 20% by mass to obtain a silver-ammonia solution, adding 0.2 g formic acid as an additive and 0.5 g potassium laurate, and heating up to 65° C. for later use;

formulating a hydroxylamine-containing solution in another 2000 mL jar: dissolving 50 g hydroxylamine and 50 g hydroxylamine nitrate in 500 mL deionized water, adding potassium hydroxide to regulate the pH in 6.5-8.5, and heating up to 35° C.;

preparing a dispersant solution in a 500 mL jar: dissolving 15 g sodium lauryl sulfate in 300 mL deionized water, adding 1.5 g gelatin, and heating up to 55° C.;

injecting and mixing the above two prepared silver-ammonia solution and hydroxylamine reducing agent solution quantitatively in a 5000 mL jar by a metering pump through a micropore at a controlled flow rate of 250 mL/min, beginning to stir at a stirring rate of 20 rpm, adding the dispersant solution dropwise in the course of reaction at a controlled dropping rate of 200 mL/min, and centrifugating after completion of the reaction to obtain spherical or nearly spherical silver powder at an average particle size of 0.1-10 um.

EXAMPLE 4

Formulating 650 mL copper sulfate solution containing 300 g/L copper in a 2000 mL jar, adding 350 mL ammonia water at a concentration of 20% by mass to obtain a copper-ammonia solution, adding 0.5 g potassium laurate, and heating up to 65° C.;

formulating a hydroxylamine-containing reducing agent solution in another 2000 mL jar: dissolving 150 g hydroxylamine in 1000 mL deionized water, adding 0.2 g sodium carbonate to regulate the pH in 6.5-8.5, and heating up to 35° C.;

preparing a dispersant solution in a 500 mL jar: dissolving 25 g triethyl hexyl phosphate in 250 mL deionized water, adding 1 g alanine and glutamic acid, and heating up to 55° C.;

injecting and mixing the above two prepared copper-ammonia solution and hydroxylamine solution quantitatively in a 5000 mL jar by a metering pump through a micropore at a controlled flow rate of 500 ml/min, beginning to stir at a stirring rate of 100 rpm, adding the dispersant solution dropwise in the course of reaction at a controlled dropping rate of 200 mL/min, and centrifugating after completion of the reaction to obtain spherical or nearly spherical copper powder.

EXAMPLE 5

Mass Production

Adding 250 kg silver nitrate solid in a 2000 L preparation tank, adding 500 L deionized water, sufficiently stirring to dissolve before adding 250 L ammonia water at a concentration of 15% by mass to obtain a silver-ammonia solution, adding 200 g formic acid as an additive and 500 g potassium laurate, and heating up to 65° C. for later use;

adding 800 L deionized water in another 2000 L preparation tank, then adding 100 kg hydroxylamine and 50 kg hydroxylamine nitrate to get sufficiently dissolved, adding 500 g potassium hydroxide to regulate the pH in 6.5-8.5, and heating up to 35° C.;

dissolving 5 kg sodium dodecyl sulfate in 100 L deionized water in a 500 L preparation tank, adding 150 g gelatin, and heating up to 55° C.;

injecting and mixing the above two prepared silver-ammonia solution and hydroxylamine reducing agent solution quantitatively in a reaction tank by a metering pump through a micropore at a controlled flow rate of 5 L/min, beginning to stir at a stirring rate of 120 rpm, adding the dispersant solution dropwise in the course of reaction at a controlled dropping rate of 2 L/min, and centrifugating after completion of the reaction to obtain spherical or nearly spherical silver powder at an average particle size of 0.1-10 um.

| Property | | Unit | Index value |
|---|---|---|---|
| Tap density | | $g/cm^3$ | 5.7-6.2 |
| Specific surface area | | $m^2/g$ | 0.5-0.7 |
| Particle size distribution | PSD D100 | um | 3.5-6.5 |
| | PSD D90 | um | 2.0-4.0 |
| | PSD D50 | um | 1.0-2.5 |
| | PSD D10 | um | 0.7-1.5 |
| Heat loss @ 110° C. | | % | <0.1 |
| Heat loss @ 538° C. | | % | <0.4 |

| Property | | Unit | Index value |
|---|---|---|---|
| Tap density | | $g/cm^3$ | 4.7-5.5 |
| Specific surface area | | $m^2/g$ | 1.3-2.2 |
| Particle size distribution | PSD D100 | um | 2.7-4.5 |
| | PSD D90 | um | 1.4-2.5 |
| | PSD D50 | um | 0.9-1.4 |
| | PSD D10 | um | 0.6-1.0 |
| Heat loss @ 110° C. | | % | <0.1 |
| Heat loss @ 538° C. | | % | <0.9 |

The technical contents and technical features of the present invention have been disclosed as above. However, those skilled in the art may still make various substitutions and modifications based on the teachings and disclosures of the present invention without departing from the spirit of the present invention. Therefore, the scope of protection of the present invention should not be limited to the contents disclosed in the examples, but should include a variety of replacement and modification without departing from the present invention, and is covered by the claims of the present patent application.

What is claimed is:

1. A method for preparing metal powder, the method comprising the steps of:

(1) preparing an ammonia-containing complex metal salt solution by dissolving a metal nitrate solid or metal sulfate solid or an equivalent amount of metal nitrate or metal sulfate liquid into deionized water and adding ammonia water, to form a solution having a molar ratio of $NH_3$:metal ion=1:0.5-5, then stirring before adding an acidic additive in an amount of 0.01%-10% by mass of the prepared ammonia-containing complex metal salt solution, and meanwhile heating the ammonia-containing complex metal salt solution to 30° C.-90° C.;

(2) preparing a solution containing hydroxylamine compounds by dissolving a metal nitrate solid or metal sulfate solid or an equivalent amount of metal nitrate or metal sulfate liquid into deionized water and adding an equivalent amount of a solid phase of the hydroxylamine compounds to the deionized water, to form a solution having a molar ratio of metal ion:hydroxylamine=1:0-10, then stirring before adding a pH regulator to regulate the pH of the solution to 2.5-9.5, and meanwhile heating the solution containing the hydroxylamine compounds to 30° C.-90° C.; and (3) mixing the ammonia-containing complex metal salt solution and the solution containing the hydroxylamine compounds by injecting both solutions together to cause a reduction reaction to happen under vigorous stirring, and centrifugating after completion of the reduction reaction to obtain spherical metal powder.

2. The method according to claim 1, wherein the step of preparing the ammonia-containing complex metal salt solution further comprises:

maintaining the metal ion content in the prepared ammonia-containing complex metal salt solution in a range of 10-500 g/L, adding 1%-30% by mass of ammonia water before stirring the ammonia-containing complex metal salt solution, then adding the acidic additive, and meanwhile heating the ammonia-containing complex metal salt solution to 30° C.-90° C. for later use.

3. The method according to claim 1, wherein in the step of preparing the ammonia-containing complex metal salt solution, further comprising selecting the acidic additive from the group consisting of an organic acid, a metal salt thereof, and a mixture of an organic acid and a metal salt thereof.

4. The method according to claim 3, wherein:

the step of preparing the ammonia-containing complex metal salt solution further comprises selecting the organic acid and the metal salt thereof from the group consisting of saturated fatty acids, metal salts thereof, unsaturated fatty acids, and metal salts thereof;

the saturated fatty acids and the metal salts thereof are selected from the group consisting of $C_nH_{2n+1}COOH$, metal salts thereof, wherein n=1, 2, 3, 4, 5, 6, 7, 8, 9, 10, 11, 12, 13, 14, 15, 16, and combinations thereof, and the metal salts are selected from the group consisting of sodium and potassium salts;

the unsaturated fatty acids and the metal salts thereof are selected from the group consisting of $C_nH_{2n}COOH$, metal salts thereof, wherein n=10, 11, 12, 13, 14, 15, 16, 17, 18, 19, 20, and combinations thereof, and the metal salts are selected from the group consisting of sodium and potassium salts.

5. The method according to claim 1, wherein the hydroxylamine compounds are selected from the group consisting of hydroxylamine, hydroxylamine sulfate and hydroxylamine nitrate, and a mixture thereof.

6. The method according to claim 1, wherein the pH regulator is selected from the group consisting of inorganic bases, inorganics acids and salts thereof.

7. The method according to claim 6, characterized in that: wherein the pH regulator is selected from the group consisting of sodium hydroxide, potassium hydroxide, sodium carbonate, potassium carbonate, nitric acid or ammonium nitrate, hydrochloric acid or ammonium chloride, sulfuric acid or ammonium sulfate solution, and combinations thereof.

8. The method according to claim 1, wherein the injecting step further comprises using the pressure generated by a pump or compressed air to inject and mix quantitatively via a micropore the ammonia-containing complex metal salt solution and the solution containing the hydroxylamine compounds, where an injection flow rate of the ammonia-containing complex metal salt solution and the solution containing the hydroxylamine compounds is controlled in the range of 0.2-50 L/min, reacting under vigorous stirring at a stirring speed of 10-500 rpm, and centrifugating after completion of the reaction to obtain spherical metal powder.

9. The method according to claim 8, wherein the injecting step further comprises adding a dispersant solution at a temperature of 30° C.-90° C. dropwise quantitatively during the reduction reaction at a dropping rate of 0.2-10 L/min and an amount of 0.1-5 L.

10. The method according to claim 9, further comprising the step of preparing the dispersant solution by dissolving into deionized water one or more acidic polyhydroxy compounds or salt compounds thereof or mixtures thereof at a content of 20-100 g/L; and then stirring before adding an amino acid or a polypeptide compound thereof at an amount of 0%-10% by mass of the dispersant solution.

11. The method according to claim 10, wherein the added amino acid or the polypeptide compound thereof is selected from the group consisting of methionine, glutamic acid, alanine, gelatin and combinations thereof.

12. The method according to claim 10, wherein the one or more acidic polyhydroxy compounds or the salt compounds thereof are selected from the group consisting of triethyl hexyl phosphate, sodium lauryl sulfate, methyl amyl alcohol, cellulose derivatives, polyacrylamide, guar gum, polyethylene glycol, fatty acid polyglycol ester, a vitamin, a sodium or potassium salt of triethyl hexyl phosphate, sodium lauryl sulfate, methyl amyl alcohol, cellulose derivatives, polyacrylamide, guar gum, polyethylene glycol, fatty acid polyglycol ester, or a vitamin, and combinations thereof.

13. The method according to claim 1, wherein the injecting step further comprises adding a dispersant solution at a temperature of 30° C.-90° C. dropwise quantitatively during the reduction reaction at a dropping rate of 0.2-10 L/min and an amount of 0.1-5 L.

14. The method according to claim 13, further comprising preparing the dispersant solution by:

dissolving into deionized water one or more acidic polyhydroxy compounds, salt compounds thereof, or a mixture of one or more acidic polyhydroxy compounds and salt compounds thereof at a content of 20-100 g/L; and then stirring before adding an amino acid or a polypeptide compound thereof at an amount of 0%-10% by mass of the dispersant solution.

15. The method according to claim 14, wherein the added amino acid or polypeptide compound thereof is selected from the group consisting of methionine, glutamic acid, alanine, gelatin and combinations thereof.

16. The method according to claim 14, wherein the one or more acidic polyhydroxy compounds and the salt compounds thereof are selected from the group consisting of triethyl hexyl phosphate, sodium lauryl sulfate, methyl amyl alcohol, cellulose derivatives, polyacrylamide, guar gum, polyethylene glycol, fatty acid polyglycol ester, a vitamin, a sodium or potassium salt of one or more of triethyl hexyl phosphate, sodium lauryl sulfate, methyl amyl alcohol, cellulose derivatives, polyacrylamide, guar gum, polyethylene glycol, fatty acid polyglycol ester, or a vitamin, and combinations thereof.

17. The method according to claim 1, wherein the metal is selected from the group consisting of copper, silver, tin and combinations thereof.

* * * * *